US006715325B2

(12) United States Patent
Sangiacomo

(10) Patent No.: US 6,715,325 B2
(45) Date of Patent: Apr. 6, 2004

(54) METHOD FOR MAKING PATTERNED PLATED KNIT FABRIC

(75) Inventor: Fulvio Sangiacomo, Brescia (IT)

(73) Assignee: Sangiacomo S.p.A., Brescia (IT)

( * ) Notice: Subject to any disclaimer, the term of this patent is extended or adjusted under 35 U.S.C. 154(b) by 0 days.

(21) Appl. No.: 10/255,433

(22) Filed: Sep. 26, 2002

(65) Prior Publication Data

US 2003/0061838 A1 Apr. 3, 2003

(30) Foreign Application Priority Data

Oct. 1, 2001 (IT) ..... BS2001A000069

(51) Int. Cl.[7] ..... D04B 27/04
(52) U.S. Cl. ..... 66/107; 66/93
(58) Field of Search ..... 66/8, 9 R, 23, 66/91, 92, 104, 107, 178 R, 180, 194, 215, 93

(56) References Cited

U.S. PATENT DOCUMENTS 4,955,211 A * 9/1990 Neher ..... 66/9 R
4,986,090 A * 1/1991 Lombardi ..... 66/9 R
5,477,707 A * 12/1995 Renda et al. ..... 66/93
5,511,393 A * 4/1996 Hu ..... 66/93
6,269,665 B1 * 8/2001 Wang ..... 66/91

* cited by examiner

*Primary Examiner*—Danny Worrell
(74) *Attorney, Agent, or Firm*—McGlew and Tuttle, P.C.

(57) ABSTRACT

The invention concerns a method of producing a knit fabric which is patterned and at least partially plated, on a circular machine equipped with a cylinder with needles (12) and sinkers (14), comprising the use of a first strand and a second strand (A, B) which are different at least in colour and which are fed to the needles through the sinkers, and the positioning of the strands through selection and a programmed longitudinal movement of the sinkers in such a way as to arrange alternately, one or other of the two strands on the reverse side and face side of the resulting knit fabric, without cutting the strands, creating patterns which are different in colour at least, in the fabric areas in which there is, on the face side or in view, one or other of the strands. This method can be used both for the production of smooth plated fabric and for the production of fabric which is part terry and part plated.

8 Claims, 4 Drawing Sheets

METHOD FOR MAKING PATTERNED PLATED KNIT FABRIC

FIELD OF THE INVENTION

This invention is concerned in general with the sector covering machines with needles and sinkers for processing knit fabrics and refers in particular to a method and the means for producing knit fabric of "plated" type, patterned, on circular knitting and hosiery machines.

BACKGROUND OF THE INVENTION

In the normal production of plated knit on said circular machines, two different yarns are normally used for gauge and/or type and/or colour, fed to the needles, arranged and processed to provide one yarn for the internal or reverse side, and the other yarn for the external or face side of a resultant knit fabric, with in particular the so-called "plated" effect.

Also noteworthy is the production of a patterned knit, also in terry fabric, with the introduction of at least two different yarns, processed so as to be presented on the internal side and the external side of the knit fabric alternately. This way of producing knit using well-known processing methods however, involves cutting the strands when their reciprocal arrangement is reversed, with the disadvantage of having thread ends protruding from the fabric, generally on its reverse side.

OBJECTS AND SUMMARY OF THE INVENTION

One object of this invention is to propose a method for knit processing to make a knit of the "plated" type, patterned, without cutting the feeder strands, thereby avoiding the disadvantage mentioned above.

Another object of the invention is to provide the knit processing conditions for production, on circular knitting and hosiery machines, of patterned plated knit fabric manufactures which do not have cut strands and which are therefore finer and more attractive in effect and appearance.

These objects are achieved, according to the invention, by a method of producing plated knit fabric on a circular machine equipped with needles and sinkers, a method which involves the use of a first strand and a second strand which are different, at least in colour, for feeding to the needles through the sinkers and the positioning of the strands by means of a programmed longitudinal movement of the sinkers in such a way as to arrange selectively one or other of the two strands on the reverse side and on the face side of the resultant knit fabric, without cutting the strands, thereby forming patterns, due to the different colouring of the zones of the knit fabric in which there is, on the face side or in view, one or other of the strands.

The method according to the invention applies with similar results in the production of both smooth or satin-finish knit fabric and terry fabric solely by changing the configuration of the sinkers for processing terry fabric and suitably operating the sinker operating cams.

BRIEF DESCRIPTION OF THE PATTERNS

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 2:
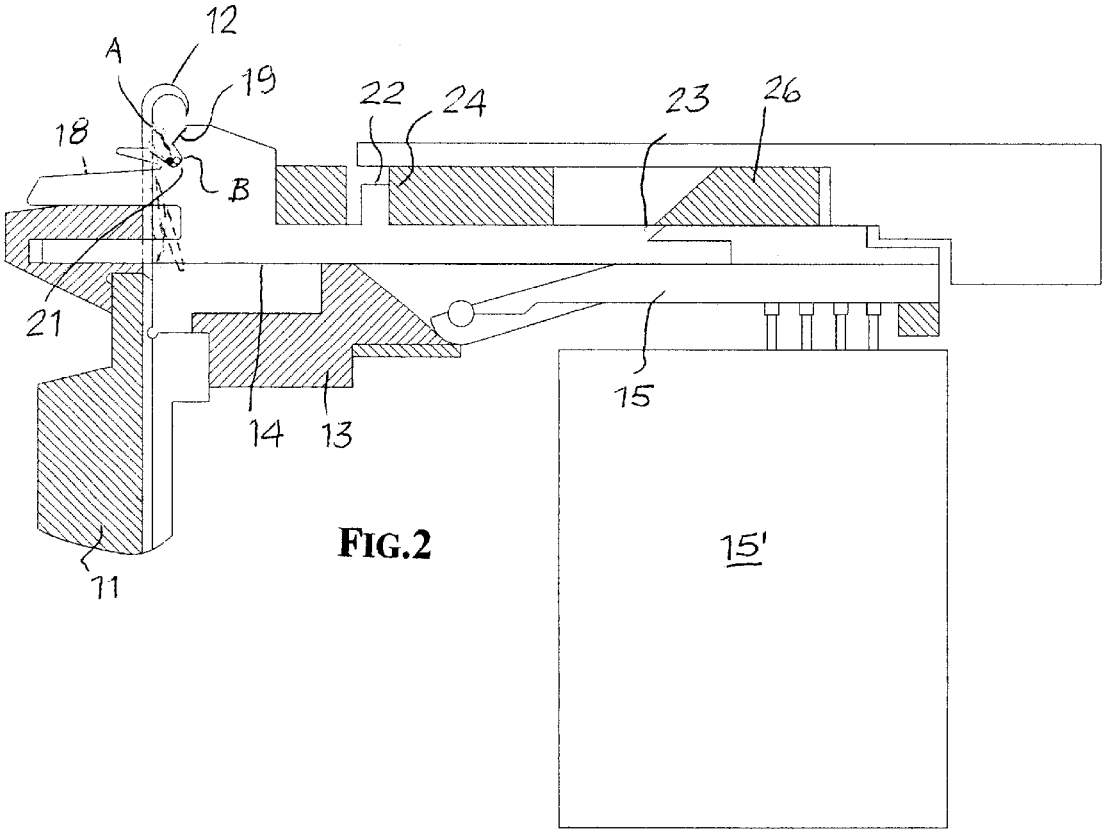
FIG. 2 shows parts of the cylinder with needles and the sinker housing ring of a circular machine with the strands for processing in the initial position on the sinker.
Figure 3:
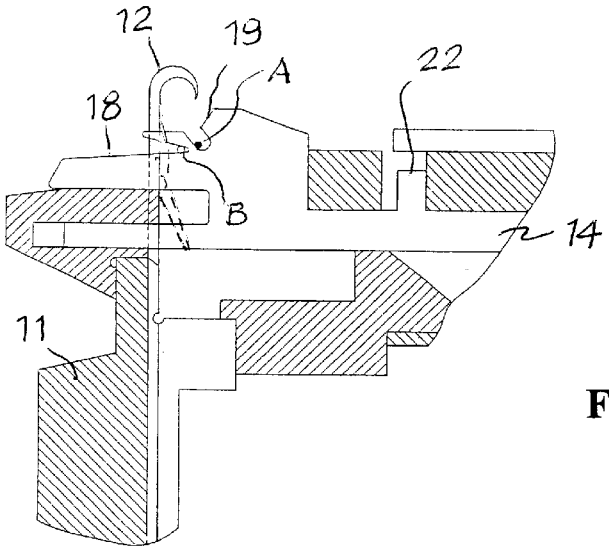
FIG. 3 shows a view similar to FIG. 2 with the strands for processing in another position.

FIGS. 2 and 3 give a partial representation of the cylinder 11 with vertical needles 12 and the ring 13 with horizontal sinkers 14 of a circular machine for processing knit fabric. The ring 13 is located at the top of the cylinder and around it, and has radial grooves aligned from the outside towards the middle of the cylinder which alternate with the needles 12. In every radial groove, the ring 13 carries a sinker 14 which can be moved longitudinally towards and away from the needle concerned, which is usually controlled so as to move vertically in relation to the sinker. The sinker 14 can also be linked to a selector 15 which is controlled by a selector group 15' whose purpose is to control the start of operation of said sinker.

To produce plated knit, the sinker 14 has a head, 16, turned towards the inside of the cylinder and a shaft 17 towards the outside. As shown in particular in FIG. 1, the head 16 of the sinker 14 is raised above the shaft 17 and presents a surface 18 for forming the knit fabric, a bevelled top 19 and between the surface 18 and the top 19, an intermediate projection 20. This projection 20 overhangs the surface for forming the fabric 18 and, with the bevelled top 19 marks the limit of a recess 21 whose purpose is to receive the strands for producing the patterned fabric. Along the shaft 17 of the sinker, a control "heel" 22 and towards the rear, a tail with a step 23, preferably angled, are arranged on the upper side.

Figure 4:
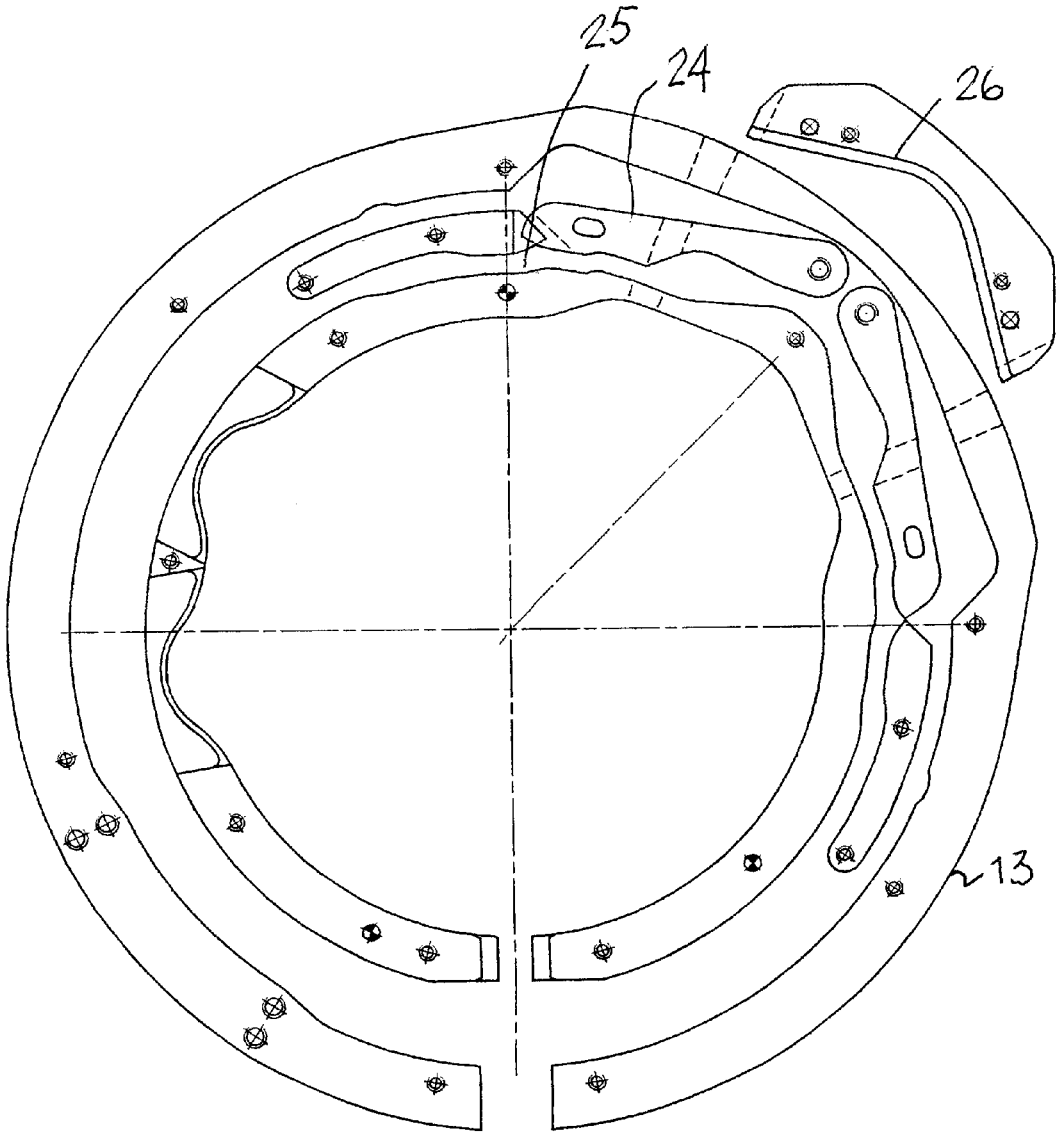
FIG. 4 shows a plan view of the cams which control the sinkers.

The heel 22 of every sinker selected is intended to interact with the input and output cams 24, 25 (FIGS. 2, 3 and 4) arranged on the ring of the sinker housing 13, for the radial movement of the sinkers 14. The tail step 23 interacts with a re-entry cam 26. Every sinker may also be liable to oscillation or tilt in a vertical plane between a position of rest or inactivity and the operating position, depending on the programme. A specific example of the sinker control cams 24, 25 and 26 is illustrated in FIG. 4 where at least one of them, cam 25, can be moved to two positions, active and inactive. Said cams are however arranged to determine selectively, depending on whether the moveable cam 25, is at least in the active or inactive position, further operating paths for the sinkers for the production of patterned plated knit fabric, normal jersey, and jersey alternating with patterned fabric.

The method for processing patterned plated knit fabric according to the invention can be put into effect by the method described, feeding the needles with a first strand, A, and a second strand, B, which differ at least in colour. Strands A and B are each fed by means of a thread guide at a suitable angle of incidence in relation to the needles 12 and the sinkers 14, with the movement of the sinkers selected by the operation of the respective cams. The radial movement of the sinkers is controlled in such a way that they can alternately receive and arrange strand A or strand B to the outside, or face, of the knit produced, without cutting the strands whilst reversing their positions.

To do this, in the course of one or more turns of the cylinder, corresponding to the production of one or more rows of knit, every sinker or group of sinkers 14, are selected and moved radially to operate with their respective cams on the sinker ring, moving forward so as to accept both strands A and B which are fed into their recess 21—FIG. 2—so that strand A, for example, shall be on the inside and strand B on the outside of the fabric produced. The other sinkers or groups of sinkers are selected, moved radially and are moved forward on the operation of their respective cams so as to take up only strand B, for example, in the recess 21 and strand A on the fabric forming surface 18, under the intermediate projection 20—FIG. 3—whereby strand A will be on the outside and strand B on the inside of the fabric produced, in a reversed position in relation to the previous one.

So when the needles 12, move up and down and the sinkers move back, the needles pick up strands A and B as they are to be arranged on their respective sinkers 14, making their respective knit stitches. In other words, some needles pick up strands A and B as they are arranged in the recess 21 of the respective sinkers and the other needles pick up strands B and A as they occur, in reversed position, in the recess 21 and on the fabric forming surface 18 of the other sinkers respectively, with the result that corresponding knit plating stitches are formed where strand A or strand B are face up and, conversely, strand B or strand A are reverse side up, in the fabric to be produced.

Figure 7:
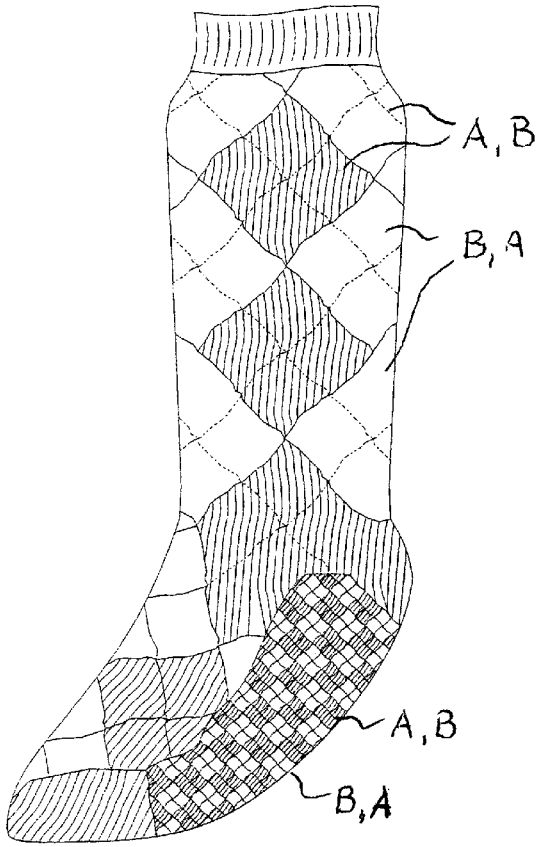
FIG. 7 shows an example of a sock which can be produced in patterned plated knit.

By repeating the individual or group selection of the sinkers, with every turn or several turns of the cylinder, according to a prepared programme, a knit fabric will be obtained with zones in which strand A will appear on the face side, and other zones in which strand B will appear on the face side, thus creating patterns, as a result of the colour differences at least of the two strands, A and B, like those shown in FIG. 7, or other patterns depending on the different sinker selection programmes.

Figure 1:
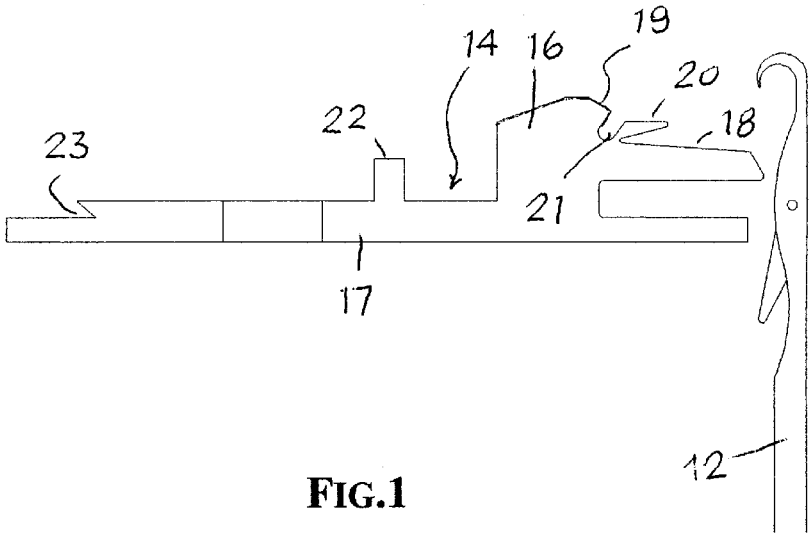
FIG. 1 shows a sinker and a needle which are linked for the processing of patterned knit, according to the invention.
Figure 5:
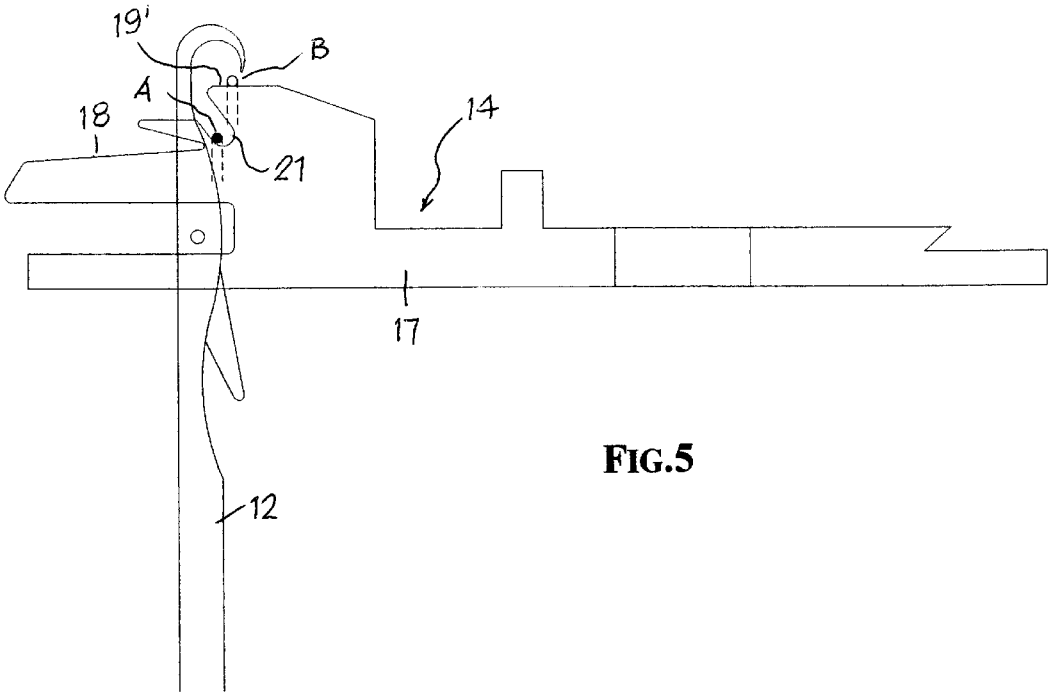
FIGS. 5 and 6 show a needle and a sinker in two positions for producing terry fabric alternating with parts of the fabric which are plated.
Figure 6:
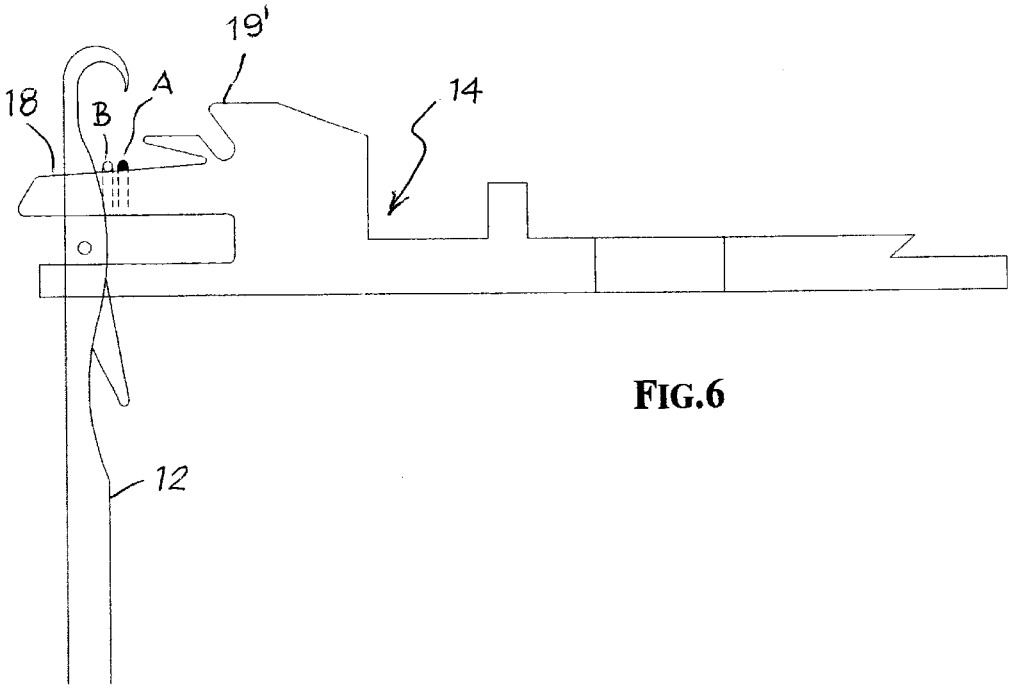

With the use of a sinker 14, of the type represented in FIG. 1, smooth or satin-finish patterned knit fabric can be produced. However, by using sinkers with a projection for jersey 19' overhanging the recess 21, as shown in FIGS. 5 and 6, a jersey fabric can be produced with the two strands A and B which are fed, and by the selective use of cams 24 and 25, a jersey fabric alternating with a plated fabric, without however, the strands being cut. In this case the stitches of the jersey material are produced with one strand, for example B, resting on the projection 19' of the sinkers and the other strand, for example A, in the recess 21—FIG. 5—while the plated fabric is produced with both strands arranged together on the fabric forming surface 18 of the sinkers, but in the opposite position in relation to the normal one, in the sense that the strand which ought to be on the inside, that is to say on the reverse, of a normal plating, will occur on the outside, that is to say on the face side of the knit fabric produced, thus creating, if it is coloured, the required chromatic effect.

("Vanise" is an alternative term for "plated")

What is claimed is:

1. Method for producing patterned knit fabric which is at least partially plated on a circular machine equipped with a cylinder with needles and sinkers, characterized by:

providing a first strand and a second strand, which are different, at least in color, to be fed to the needles through the sinkers, and positioning said strands through selection and moving longitudinally the sinkers in such a way as to present one or other of the two strands with reverse side and face side of the resulting knit fabric, without cutting the strands, creating patterns through color difference at least, in the knit fabric areas in which there is, on the face side or in view, one or other of the strands.

2. Method for making knit fabric according to claim 1 by which, in the course of one or more turns of the cylinder, for the production of one or more rows of knit, every sinker or group of sinkers is selected and moved forward towards the needles so that both strands are picked up in a first position, so that one strand shall be on the inside and the other strand on the outside of the fabric produced while other sinkers or groups of sinkers are selected and move forward towards the needles so that said strands are taken up into a second position, reversed in relation to the previous one, so that one strand will be on the outside and the other strand on the inside of the resulting fabric, produced by the needles selected to pick up and process the strands in the first position and the second position on the sinkers respectively.

3. Method according to claim 2 in which the two strands in said first position are both accepted in the recess of each sinker when picked up by their respective needles, and in which the two strands in said second position are accepted by two different parts of each sinker when picked up by their respective needles to produce a knit fabric with a satin-finish.

4. Method for making knit fabric according to claim 1 by which, in the course of one or more turns of the cylinder, for the production of one or more rows of knit, every sinker or group of sinkers is selected and moved forward towards the needles far enough to accept the strands being fed, in a first position, so that one strand makes jersey knit stitches and the other ground fabric, while the other sinkers or groups of sinkers are selected and moved forward towards the needles so as to accept both strands next to each other in a second position to produce plated knit with one strand on the outside and the other on the inside of the resulting fabric.

5. Method for producing knit fabric according to claim 4 in which the two strands in said first position are accepted, one on a jersey projection and the other in the recess of each sinker when picked up by their respective needles, and in which the two strands in said second position are both accepted by the fabric forming surface of each sinker when picked up by their respective needles, to produce a knit fabric partially jersey and partially plated, with the strands in the plated knit in a reverse position in relation to a normal plated knit fabric.

6. A sinker of a circular knitting machine equipped with needles for producing a patterned plated knit with satin finish and using a first strand and a second strand, which are different, at least in color, to be fed to the needles through the sinkers, and positioning of said strands through selection and programmed longitudinal movement of the sinkers in such a way as to present one or other of the two strands with reverse side and face side of the resulting knit fabric, without cutting the strands, creating patterns through color difference at least, in the knit fabric areas in which there is, on the face side or in view, one or other of the strands, including a head and a shaft, where the head of the sinker is raised above the shaft and presents a surface for forming the knit fabric, a beveled top and between said surface and said top, an intermediate projection which overhangs the surface for forming the fabric (18) and which, with the beveled top, marks the limit of a recess and where along the shaft of the sinker are arranged, on an upper side, a control "heel" and towards a rear a tail with a step, the recess of the sinker being intended to receive the two strands in a first position for feeding the needles, the recess and the surface for forming the fabric of the sinker being intended to receive the two strands individually in a second position, reversed, to feed the needles, while the heel and the tail step of the sinker shaft are intended to act with cam means for controlling the movements of the sinkers.

7. A sinker of a circular knitting machine equipped with needles for producing a knit fabric which is at least partially jersey without cutting the strands, the sinker comprising a head and a shaft, where the head of the sinker is raised above the shaft and presents a surface for forming the knit fabric, an upper projection and between said surface and said upper projection, an intermediate projection which overhangs the surface for forming the fabric and, with the upper projection marks a limit of a recess and where along the shaft of the sinker are arranged, on an upper side, a control "heel" and towards a rear, a tail with a step, the upper projection and the recess of the sinker being intended to take individually one or other of the two strands in a first position for feeding to the needles, the surface for forming the fabric of the sinker being intended to take the two strands next to each other in said a second position for feeding to the needles, whilst the heel and the step of the sinker shaft tail are intended to act together with a cam means for controlling movement of the sinkers.

8. A circular hosiery or knitting machine equipped with needles and sinkers for using a first strand and a second strand, which are different, at least in color to be fed to the needles through the sinkers, and positioning of said strands through selection and programmed longitudinal movement of the sinkers in such a way as to present one or other of the two strands with a reverse side and a face side of the resulting knit fabric, without cutting the strands, creating patterns through color difference at least, in the knit fabric areas in which there is, on the face side or in view, one or other of the strands, the sinkers including a head and a shaft, where the head of the sinker is raised above the shaft and presents a surface for forming the knit fabric, a beveled top and between said surface and said top, an intermediate projection which overhangs the surface for forming the fabric and which, with the beveled top, marks a limit of a recess and where along the shaft of the sinker are arranged on an upper side, a control "heel" and towards a rear, a tail with a step, the recess of the sinker being intended to receive the two strands, in a first position for feeding the needles, the recess and the surface for forming the fabric of the sinker being intended to receive the two strands individually in a second position, reversed, to feed the needles, while the heel and the tail step of the sinker shaft are intended to act with a cam means for controlling movements of the sinkers with a cover which has control cams for sinkers for producing patterned plated knit fabric and control cams for sinkers for producing jersey knit fabric interspersed with plated knit, at least one of said cams being movable between an active position and an inactive position, depending on the fabric being produced.

* * * * *